US005904295A

United States Patent [19]

Kuykendal et al.

[11] Patent Number: 5,904,295

[45] Date of Patent: May 18, 1999

[54] POP JET FOUNTAIN

[76] Inventors: Robert L. Kuykendal, 1136 Washington St.; Ronald S. Deichmann, 1135 Washington St., both of St. Louis, Mo. 63101

[21] Appl. No.: 08/876,308

[22] Filed: Jun. 16, 1997

[51] Int. Cl.[6] ..... B05B 17/08

[52] U.S. Cl. ..... 239/17; 239/18; 239/23

[58] Field of Search ..... 239/16–23, 12, 239/99, 101, 553, 553.3, 553.5, 590, 590.3, 590.5

[56] References Cited

U.S. PATENT DOCUMENTS

| | | | |
|---|---|---|---|
| 3,484,045 | 12/1969 | Waters | 239/22 |
| 3,801,010 | 4/1974 | Hruby, Jr. | 239/17 |
| 4,795,092 | 1/1989 | Fuller | 239/12 |
| 5,160,086 | 11/1992 | Kuykendal et al. | 239/18 |
| 5,161,740 | 11/1992 | Kuykendal et al. | 239/23 |
| 5,678,617 | 10/1997 | Kuykendal et al. | 239/16 |

*Primary Examiner*—Andres Kashnikow
*Assistant Examiner*—Lisa Ann Douglas
*Attorney, Agent, or Firm*—Henry W. Cummings

[57] ABSTRACT

An enclosure made of rugged metal or plastic is provided including a top, at least one side wall and a bottom. An inlet is provided in the bottom wall and an internal chamber is provided above the inlet. This internal chamber contains a valve similar to valve 20 which is capable of opening and closing rapidly and may be controlled by external electrical or hydraulic power. Preferably a commercial available filter screen material is provided in the inlet to the internal chamber to insure that no large particles which would harm the system, are permitted to enter the internal chamber. The internal chamber is in fluid communication with an upper chamber which is preferably cylindrical and which optionally includes the diffuser material to reduce turbulence. After the fluid flows through the upper chamber, it is in substantially laminar flow and exits through a knife edge orifice into an outer chamber pool defined by an extension of the outer enclosure and the top of the enclosure. Since the fluid flowing through the knife edged orifice is of low turbulence as it passes through the secondary pool defined by the enclosure extension, the surface tension of the ball of fluid is able to prevent it from flying apart into multiple drops. The discharged ball tends to remain in one surface tension envelope, even if it changes in shape and response to the air currents and resembles an amoebae. The single enclosure structure of the present invention is easily connected to available pipe nipples pools in presently constructed amusement parks. In addition, it is less expensive than forming two enclosures, one for the upper chamber and orifice and one for the accumulator. The rugged outer enclosure protects the internal workings of the control valve, optional diffuser material and the knife edge orifice.

12 Claims, 3 Drawing Sheets

POP JET FOUNTAIN

I. FIELD OF INVENTION

This invention relates to an improved method and apparatus for forming an inproved Pop Jet Fountain with a fluid orifice which creates a laminar discharge stream, and a valve means which periodically forms fluid balls due to the surface tension of the fluid ball.

II. BACKGROUND OF THE INVENTION

In U.S. Pat. 5,161,740 a pop jet fountain is disclosed including a separate accumulator 28 having an upper chamber 30 where air is located and a separate enclosure 10 containing a diffuser material 18 and a knife edged orifice in communication with an upper chamber 16. Pressurized fluid is input through a conduit 36 containing a by-pass valve 32 into a conduit 34. The fluid material is accumulated in the accumulator 28 and a conduit 21 contains a control valve 20 which activates the pop jet operation to periodically form ball in an amoebae shape due to the surface tension of the ball.

While this structure has been commercially successful, it involves the formation of two enclosures or containers 10 and 28.

Furthermore, this construction is less adapted to being located in the pool arrangements normally found in amusement parks which include a pump or other pressure source, one or more control valves and a threaded nipple to connect to the pop jet fountain structure.

III. SUMMARY OF THE INVENTION

A. Objects of the Invention

One object of the present invention is to provide a structure which is readily adaptable to the existing fluid pressure apparatus available at pools in existing amusement parks.

Another object of the present invention is to avoid the need to construct two separate enclosures in the Pop Jet Fountain apparatus.

Another object of the present invention is to provide a single enclosure for the pop jet fountain apparatus which can be constructed of rugged material and protect the internal portions of the pop jet fountain structure.

Other objects will be apparent from the following description and drawings.

B. Summary

An enclosure made of rugged metal or plastic is provided including a top, at least one side wall and a bottom. An inlet is provided in the bottom wall and an internal chamber is provided above the inlet. This internal chamber contains a valve similar to valve 20 in the '740 patent which is capable of opening and closing rapidly and may be controlled by external electrical or hydraulic means. Preferably a commercial available filter screen material is provided in the inlet to the internal chamber to insure that no large particles which would harm the system, are permitted to enter the internal chamber. The internal chamber is in fluid communication with an upper chamber which is preferably cylindrical and which optionally includes the diffuser means discussed in the '086 and '740 patents. After the fluid flows through the upper chamber, it is in substantially laminar flow and exits through a knife edge orifice into an outer chamber pool defined by an extension of the outer enclosure and the top of the enclosure. Since the fluid flowing through the knife edged orifice is of low turbulence as it passes through the secondary pool defined by the enclosure extension, the surface tension of the ball of fluid is able to prevent it from flying apart into multiple drops. The discharged ball tends to remain in one surface tension envelope, even if it changes in shape and response to the air currents and resembles an amoebae. The single enclosure structure of the present invention is easily connected to available pipe nipples pools in presently constructed amusement parks. In addition, it is less expensive than forming two enclosures, one for the upper chamber and orifice and one for the accumulator. The rugged outer enclosure protects the internal workings of the control valve, optional diffuser means and the knife edge orifice.

IV—THE DRAWINGS

V—DESCRIPTION OF PREFERRED EMBODIMENTS

Figure 1:
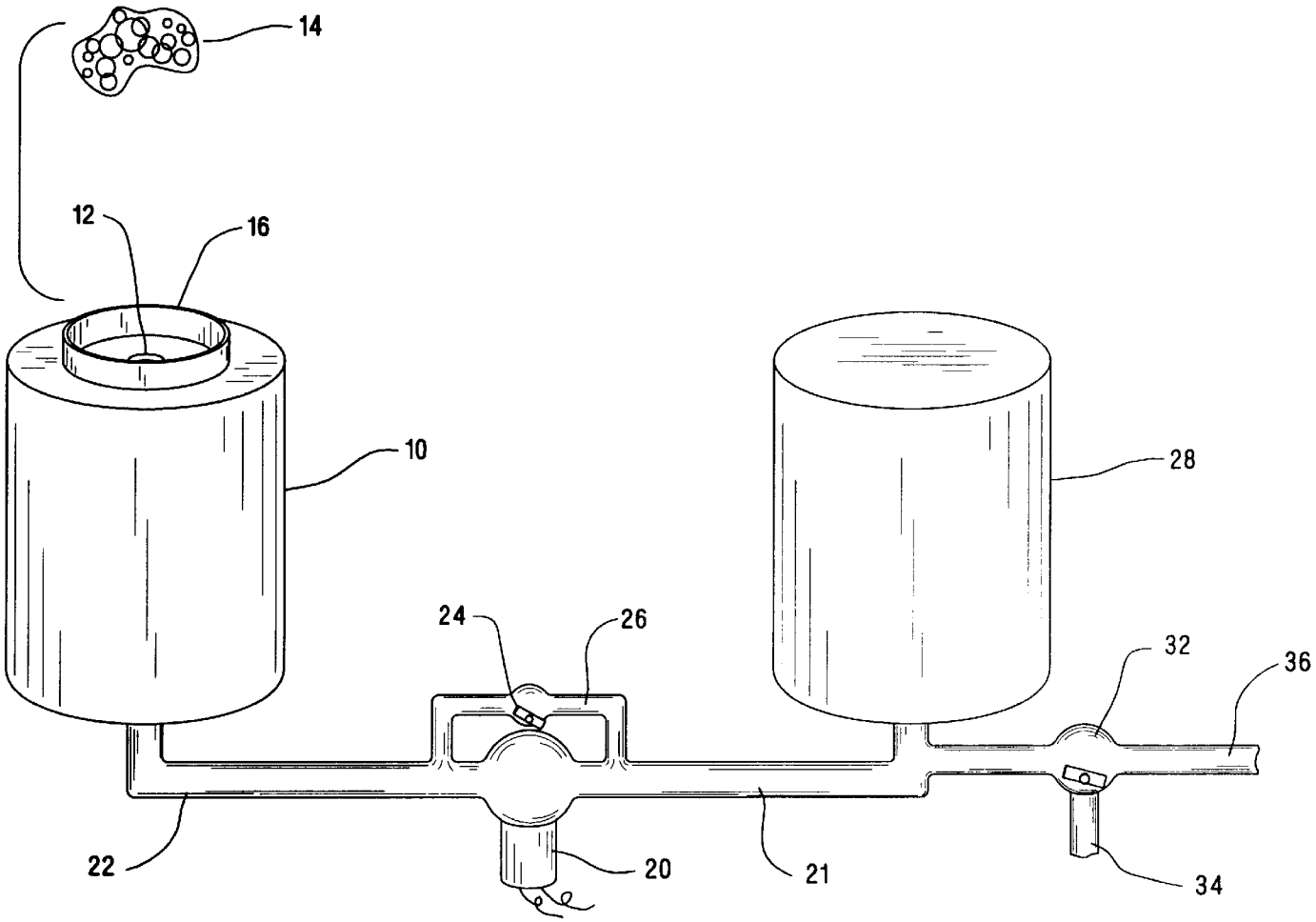
FIG. 1 Prior Art
FIG. 1 is a perspective view of a prior art construction.
Figures 2, 3:
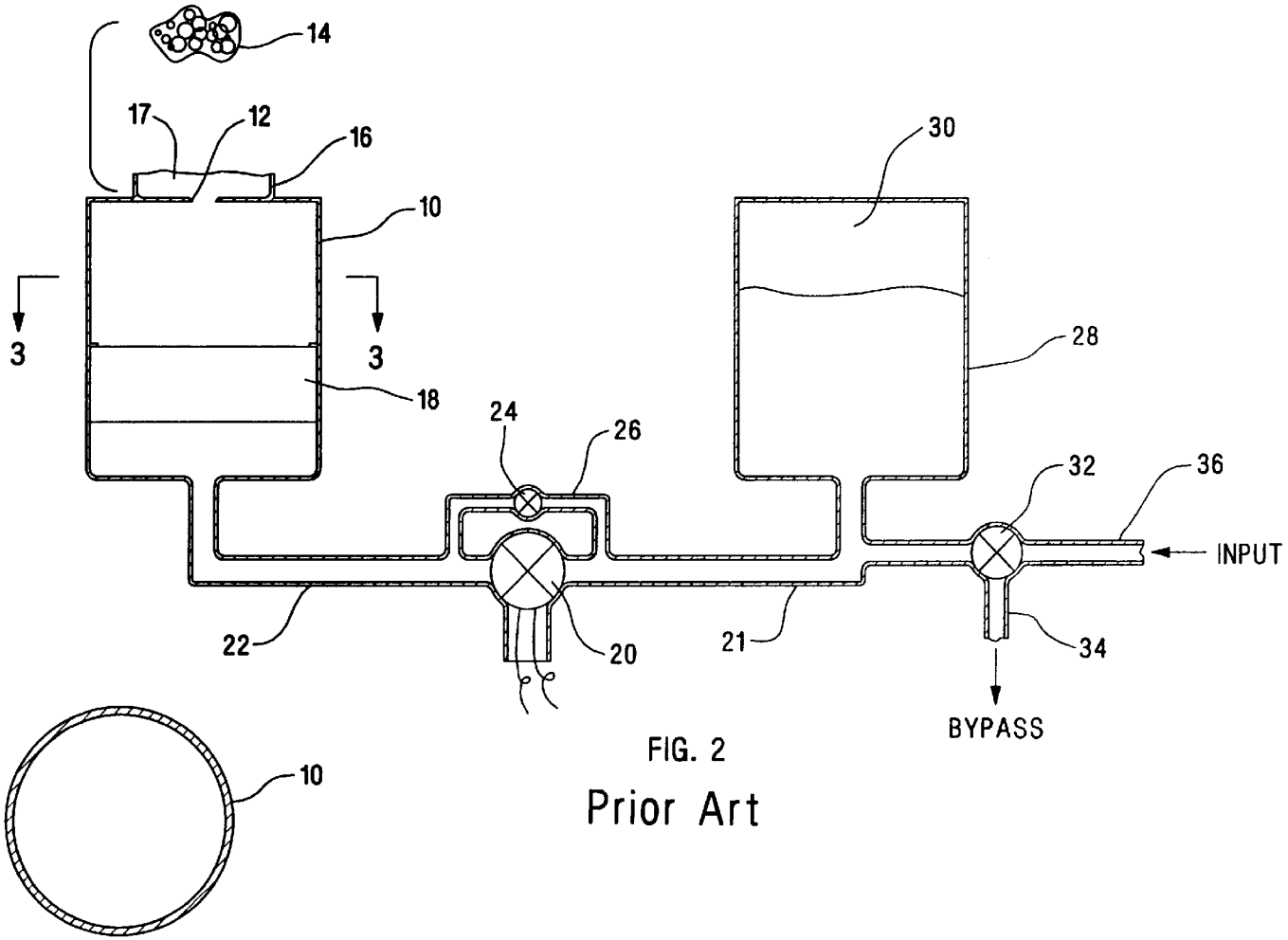
FIG. 2 Prior Art
FIG. 3 Prior Art
FIG. 2 is a vertical sectional view of the prior art structure shown in FIG. 1.
FIG. 3 is a vertical sectional view of the prior art structure shown in FIG. 2 looking in the direction of the arrows along the line 3—3 in FIG. 2.
Figure 5:
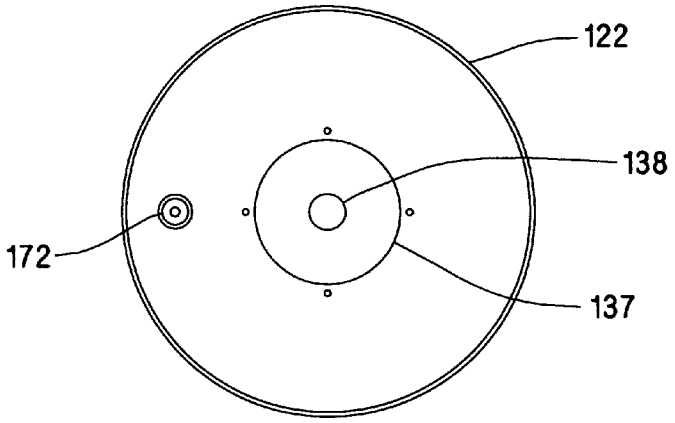
FIG. 5 is a plan view of the improved pop jet of the present invention.
Figure 4:
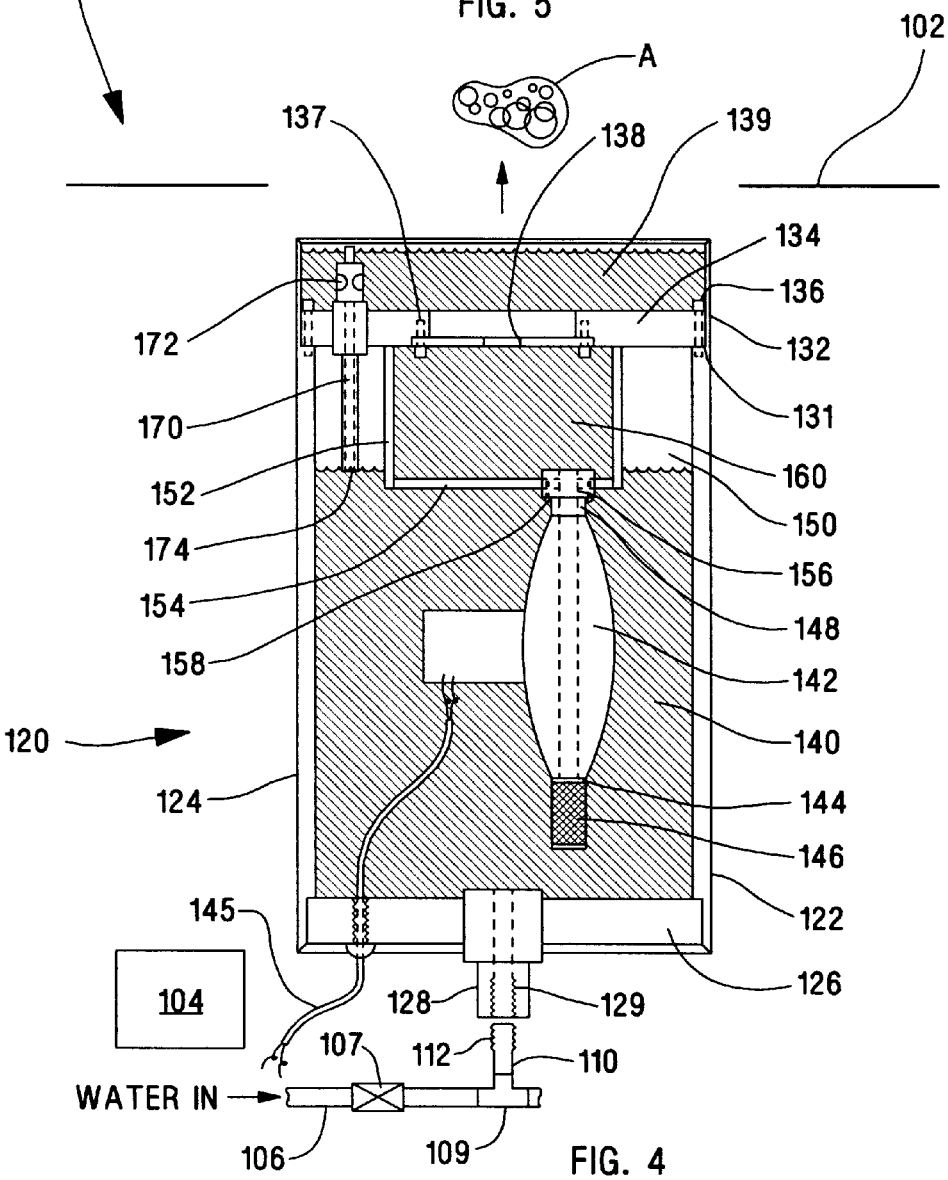
FIG. 4 is a vertical sectional view of the improved pop jet of the present invention, including a schematic view of presently available pools in amusement parks containing pump control valves and pipe nipples.

The related prior art construction previously described in the Background of the Invention hereinabove in U.S. Pat. No. 5,161,740 is hereby incorporated into the present application by this reference.

In amusement parks 100 having a pool 102, a source of fluid pressure such as a pump 104 is in fluid communication with a conduit 106 containing a control valve 107 which is in fluid communication by means of a tee 109 with a pipe nipple 110 having external threads 112.

If this structure is not available in existing amusement park pools, it is easily provided and is of known conventional construction.

In accordance with the present invention indicated generally at 120, an enclosure 122 made of metal or plastic which is conveniently, though not necessarily cylindrical, includes a vertical wall 124 and a bottom wall 126 in fluid communication with a conduit 128, having threads 129 adopted to engage the threads 112 of the pipe nipple 110.

The enclosure 122 includes an upper flange 131 and a top plate 134 is supported by the flange and held in place with mechanical fasteners 136 or by welding. The top plate 134 includes a knife edged orifice 138 held in place with fasteners 137 constructed according to the teachings in U.S. Pat. Nos. 5,161,740, and 5,160,086, also incorporated into the present application by this reference. Enclosure 122 extends above top plate 134 at 132 and defines a chamber 139.

Located inwardly from the wall 124, is an internal chamber 140. A control valve 142 is located within the chamber 140. Control valve 142 is similar to the control valve 20 described in the '740 patent. Control valve 142 has a lower conduit end 144 which has located therein a commercially available filter screen 146 to filter out large particles which would harm the system.

Conduit 142 has an upper conduit end 148 which is in fluid communication with an upper internal enclosure 150, having a vertical wall 152 and a bottom 154, having an inlet opening 156 through which conduit end 148 is in fluid communication and is connected thereto by mechanical fasteners 158. Internal enclosure 150 is preferably cylindrical and optionally includes diffuser material 160.

The diffuser material is of the type herein described in greater detail in U. S. Pat. Nos. 5,161,740 and 5,160,086, each of which has already been incorporated into this Description of Preferred Embodiments by reference. The diffuser material, provides a very large number of parallel fluid paths to dampen major currents by lowering the fluid velocity and the Reynolds Number. Thus the fluid passing through diffuser means 160 into the orifce 138, is essentially flowing in laminar flow.

A conduit 170 also extends through top plate 134 and includes a valve 172 at its top and an opening 174 at its bottom to provide fluid communication with the fluid within wall 124. This is essentially a by-pass conduit which allows fluid to exit the lower fluid chamber 140 when valve 144 is not activated.

When valve 142 is activated, because of the total flow area through the outside enclosure 122 and through the chamber 140 is greater than through inlet opening 156, the Reynolds number and turbulence of the fluid flow is greatly reduced. Thus the fluid that flows out through the knife edged orifice 138 has a very low turbulence. As this fluid then passes into the secondary pool 139, it remains at low turbulence while it picks up additional fluids by molecular adhesion and air bubbles. Because valve 142 is capable of opening and closing rapidly by external electrical 145 or hydraulic control, the flow of fluid out of the pop jet orifice is of relatively short duration. Since the fluid remains relatively low in the secondary pool 139, the surface tension surrounding the ball of fluid discharged is able to essentially prevent it from flying apart into multiple drops. Thus the discharge ball of fluid tends to remain in one surface tension envelope, even with changes in shape in response to air currents, resembling an amoebae A.

The present invention has the advantages over the '740 patent in that it is much easier to connect to presently available pipe nipples with a threaded connection. In addition, it is less expensive than forming two enclosures, one for the orifice and one for the accumulator. The rugged outer enclosure protects the internal workings of the control valve, the diffuser means and the knife edge orifice.

What is claimed is:

1. An improved pop jet fountain comprising:

an outer wall enclosure having inlet means at a lower portion adapted to engage fluid pressure sources in commercially available pool installations;

said enclosure including a top surface having a knife edged orifice;

said enclosure having an extension above said top surface defining an upper chamber;

a lower chamber located within said enclosure having an opening in fluid communication with said inlet means and containing valve means adapted to be operated in a rapid on and off manner;

said lower chamber being in fluid communication with an upper enclosure, said upper enclosure engaging said top surface and and having an opening providing fluid communication between said lower chamber and said knife edged orifice;

whereby said outer wall enclosure may be readily connected to existing pressure providing systems in amusement park and other pools, fluid passes through said inlet means into said lower chamber, said lower chamber defining an accumulator, a portion of said fluid passes through said valve means, when said valve means is activated fluid flows into said upper enclosure and through said knife edged orifice into said upper chamber whereby the surface tension surrounding balls of fluid thus discharged, is able to essentially prevent it from flying apart into multiple drops.

2. An improved pop jet fountain according to claim 1 including a by-pass conduit providing fluid communication between said outer lower chamber and said upper chamber and second valve means located within said by-pass conduit.

3. An improved pop jet fountain according to claim 2, including said valve means has an inlet and filter means provided in said inlet.

4. An improved pop jet fountain according to claim 3, wherein said outer enclosure includes flange means which support said top surface.

5. An improved pop jet fountain according to claim 1, wherein connecting means is provided on said enclosure inlet means including a depending conduit portion and connecting means to connect to available fluid pressure sources, whereby said outer enclosure may be readily connected to existing pressure systems in amusement park and other pools.

6. An improved pop jet fountain according to claim 1, wherein diffuser means is located in said upper enclosure;

said diffuser means defining a large number of small area flow paths across the flow area for developing laminar flow by reducing the Reynolds number of flow within said upper enclosure.

7. A method of making an improved pop jet fountain comprising:

providing an outer wall enclosure having inlet means at a lower portion adapted to engage fluid pressure sources in commercially available pool installations;

forming a top surface on said enclosure;

forming a knife edged orifice on said top surface;

forming on said enclosure an extension above said top surface defining an upper chamber;

forming a lower chamber within said enclosure having an opening in fluid communication with said inlet means;

locating valve means within said lower chamber adapted to be operated in a rapid on and off manner;

locating an upper enclosure in fluid communication with said lower chamber;

extending said upper enclosure to engage said top surface to provide fluid communication between said inlet means and said knife edged orifice;

connecting said outer enclosure to existing pressure providing systems in amusement park and other pools, wherby fluid passes through said inlet means into said lower chamber, said lower chamber defining an accumulator, a portion of said fluid passes through said valve means;

activating said valve means to force fluid into said upper enclosure and through said knife edged orifice to obtain substantially laminar flow and into said upper chamber whereby the surface tension surrounding balls of fluid thus discharged, is able to essentially prevent it from flying apart into multiple drops.

8. A method of forming an improved pop jet fountain according to claim 7 including locating a by-pass conduit and providing fluid communication between fluid in the lower portion of said outer enclosure and said upper chamber and providing second valve means within said by-pass conduit.

9. A method of forming an improved pop jet fountain according to claim 8, including providing an inlet to said valve means and locating filter means in said inlet.

10. A method of forming an improved pop jet fountain according to claim 9, including providing said outer enclosure with flange means and supporting said top surface with said flange means.

11. A method of forming an improved pop jet fountain according to claim 10, including providing connecting means on said inner enclosure having a lower portion and connecting fluid pressure to said enclosure inlet means.

12. A method of forming an improved pop jet fountain according to claim 10, including locating diffuser means in said upper enclosure;

said diffuser means defining a large number of small area flow paths across the flow area, and developing laminar flow by reducing the Reynolds number of flow within said upper enclosure.

* * * * *